United States Patent [19]

Chapman, III

[11] Patent Number: 4,496,010

[45] Date of Patent: Jan. 29, 1985

[54] SINGLE-WIRE SELECTIVE PERFORMATION SYSTEM

[75] Inventor: Joseph E. Chapman, III, Houston, Tex.

[73] Assignee: Schlumberger Technology Corporation, Houston, Tex.

[21] Appl. No.: 394,948

[22] Filed: Jul. 2, 1982

[51] Int. Cl.[3] ..... E21B 43/116

[52] U.S. Cl. ..... 175/4.55; 102/215; 102/217; 102/317

[58] Field of Search ..... 175/4.55; 361/248, 249; 102/317, 319, 322, 215, 217

[56] References Cited

U.S. PATENT DOCUMENTS

| | | | |
|---|---|---|---|
| 2,297,006 | 9/1942 | Lohman | 164/0.5 |
| 2,546,686 | 3/1951 | Bickel et al. | 102/27 |
| 2,821,136 | 1/1958 | Castel | 102/21.6 |
| 2,871,784 | 2/1959 | Blair | 102/21.6 |
| 3,010,396 | 11/1961 | Coleman | 102/21.6 |
| 3,102,476 | 9/1963 | Naeseth | 102/22 |
| 3,126,964 | 3/1964 | Rue | 166/55.5 |
| 3,133,231 | 5/1964 | Fail et al. | 317/80 |
| 3,246,707 | 4/1966 | Bell | 175/4.54 |
| 3,306,208 | 2/1967 | Bergey et al. | 102/70.2 |
| 3,312,869 | 4/1967 | Werner | 317/80 |
| 3,316,451 | 4/1967 | Silberman | 317/80 |
| 3,327,791 | 6/1967 | Harrigan, Jr. | 175/4.55 |
| 3,327,792 | 6/1967 | Boop | 175/4.54 |
| 3,380,540 | 4/1968 | Fields | 175/4.55 |
| 3,417,259 | 12/1968 | Nozawa et al. | 307/108 |
| 3,424,924 | 1/1969 | Leisinger et al. | 307/252 |
| 3,441,093 | 4/1969 | Boop | 175/4.55 |
| 3,517,757 | 6/1970 | Hart | 175/4.55 |
| 3,517,758 | 6/1970 | Schuster | 175/4.55 |
| 3,571,605 | 3/1971 | Dobson | 307/41 |
| 3,603,844 | 9/1971 | Fritz | 317/80 |
| 3,717,095 | 2/1973 | Vann | 102/21.6 |
| 3,748,955 | 7/1973 | Gatermann et al. | 89/1.814 |
| 3,762,331 | 10/1973 | Vlahos | 102/322 |
| 3,768,408 | 10/1973 | Hallmark | 102/21.6 |
| 3,773,120 | 11/1973 | Stroud et al. | 175/4.55 |
| 3,780,654 | 12/1973 | Shimizu | 102/215 |
| 3,851,589 | 12/1974 | Meyer | 102/217 |
| 3,934,514 | 1/1976 | Dawkins | 102/70.2 |
| 3,935,514 | 1/1976 | Ellin | 361/249 |
| 4,007,796 | 2/1977 | Boop | 175/4.55 |
| 4,051,907 | 10/1977 | Estes | 175/4.55 |
| 4,100,978 | 7/1978 | Boop | 175/4.55 |
| 4,157,069 | 6/1979 | Gustafsson et al. | 102/200 |
| 4,208,966 | 6/1980 | Hart | 102/20 |

*Primary Examiner*—William F. Pate, III

[57] ABSTRACT

A method and system for selecting and arming each one of a plurality of firing modules in a single-line selective perforating system is disclosed. A single firing line connects each firing module one at a time in a sequence to a control unit to receive power and control signals therefrom. Each module generates internally a module active time interval in response to being connected to the firing line power. Each time interval has a first portion during which the module generates an identification pulse to the control unit to indicate that another module has been connected to the firing line, and a second portion during which the module is enabled to receive a selection pulse from the control unit to terminate further sequencing of the modules to locate the module to be selected. The next module to receive power from the control unit is connected to the firing line by a pass-thru switch in the last connected module at the end of its active time interval if that module was not selected for firing.

59 Claims, 3 Drawing Figures

SINGLE-WIRE SELECTIVE PERFORMATION SYSTEM

CROSS REFERENCE TO RELATED APPLICATION

Reference is hereby made to a related co-pending application Ser. No. 394,949, and entitled "A Single-Wire Selective Perforation System Having Firing Safeguards," filed concurrently herewith. Both the present application and the cross referenced application are assigned to the same Assignee.

BACKGROUND OF THE INVENTION

This invention relates to perforating guns used in well completion operations. More particularly, the present invention relates to a single-wire selective gun perforating system capable of selecting and firing in an arbitrary order each gun in a plurality of guns connected in a firing string.

Typical prior-art perforating guns generally used in well completion operations consist of a plurality of guns connected vertically to form an assembly or firing string suitable for lowering into a well borehole. Each gun will contain one or more shaped charges. Each charge will have a detonator or blasting cap connectable to a firing wire for receiving an electrical firing pulse to detonate the charges.

It is often desirable in well completion operations to have each gun selectable for firing rather than having all guns firing at the same time. Firing all guns at the same time produces a perforation spacing determined by the spacing of the guns in the string, usually in a closely-spaced arrangement. On the other hand, individual detonation of the charges permits perforations to be made at various selected depths, and in various selected (often widely separated) zones. As each charge is detonated, the string can be repositioned to the next level where another perforation is desired, and another gun fired. This process can continue until the proper perforation spacing is obtained with the desired number of shots. A further benefit is obtained from the single detonation of the guns—verification that each gun fired and that the proper number of perforations was obtained.

Many selective firing systems and methods have been used in the prior art to select a gun for firing from among the plurality of guns in the string. U.S. Pat. No. 4,051,907 discloses one such system comprising a surface control unit for controlling the selection and firing of the guns in a firing string comprised of a subsurface master unit operatively connected to a plurality of identical slave sub units or firing modules that may be armed and fired in an arbitrary order under control of the master unit and an operator.

Sequencing through the firing modules for selection of a module to be fired is under control of the surface located control unit. The selection process begins at the uppermost firing module closest to the master unit. Each firing module contains a pulse counter which receives pulses from the surface via the master slave unit when that module has been connected to the firing line power. A predetermined number of pulses (8 pulses) sequences the counter through nine counts. At selected counts, certain operations are effected in the module. For example, at count 4 a current pulse is placed on the firing line, at count 5 a switch is closed to charge a firing capacitor with the voltage currently on the firing line, at count 6 a firing pulse whose amplitude is equal to the current voltage on the firing line is applied to a blocking zener diode which is connected to a firing switch (the firing switch is not closed because the voltage on the firing line is not greater than the break over voltage of the zener diode), and at count 9 a pass-through switch is closed to pass the firing line power on down to the next lower module in the string.

The above described process is then repeated for the next module to be connected to the firing line power. As long as eight pulses are issued without a change in the firing line power, the sequencing through the firing modules will continue, one at a time. When the firing module to be selected and fired is reached, only six pulses will be issued by the master unit under control of the operator. These six pulses take the pulse counter in the firing module to be selected to a count of five which closes the switch which connects the firing line to the firing capacitor. At this point, the operator at the surface activates the arm switch which raises the firing line voltage, and thus the firing capacitor, to a value sufficient to detonate the charge when the capacitor is discharged into the blasting cap. Six pulses arm the firing module with one more pulse causing a closing of the firing switch to occur since the firing line voltage is now greater than the blocking zener diode voltage to permit the firing switch to be closed. Closure of the firing switch connects the firing capacitor across the blasting cap circuit.

These prior-art selective perforating systems, such as that disclosed in U.S. Pat No. 4,051,907, suffer from several disadvantages. One disadvantage is the need for elaborate surface and subsurface circuitry with continuous supervision and interaction required between the surface and subsurface circuitry during the selection process to effect the selection and arming of the firing modules. Another disadvantage is that sequencing through the firing modules is solely under control of the surface equipment. Another disadvantage is the lack of any safeguards for detecting faults in the firing string which will prohibit the proper firing of a single selected module.

Accordingly, it would be advantageous to provide a single-wire selective perforating system which provides for the automatic sequencing through the firing modules in a sequence, one at a time, under control of the modules themselves until a module to be selected is receiving power from the firing line. At that time the module can be selected and armed for firing. It would also be advantageous to provide a single-wire selective perforating system which includes safeguards for determining if a single module has been connected in the sequence to the firing line and is operating within predicted power limits thereby insuring that one module is being selected for firing and that only that module will be fired by the firing pulse.

SUMMARY OF THE INVENTION

In accordance with the present invention, a single-line selective perforating system having a single firing line for electrically connecting a firing control unit to each of a plurality of shot modules is disclosed. Connection of the control unit to the shot modules occurs one at a time in a predetermined sequence where each module is adapted for connecting the connected control unit to a next module.

The method of selecting a module for firing comprises the single step of connecting each module one at a time in the predetermined sequence to the firing line under control of module active time intervals. The module active time intervals are generated internally in the modules, where each module generates an active time interval in response to being connected to the firing line and where the next module in the sequence is automatically connected to the firing line at the end of the active time for the last connected module if that module was not selected for firing during its active time interval.

The step of connecting each module to the firing line comprises the steps of first applying power to the firing line in the form of voltage and current for powering the modules connected to the firing line. A module active time interval is generated in the module last connected to the firing line power. The module just connected to the firing line power then generates an identification pulse to indicate to the control unit that a next module has been connected to the firing line power. At the completion of the module active time interval, a pass-through switch is controlled to connect the firing line power to the next module in the sequence. Finally, the steps of generating a module active time interval, an identification pulse and controlling the pass-through switch are repeated until the module to be selected is generating an active time interval. During the time interval for the module to be selected, the control unit may generate a selection pulse to select the module for firing thereby terminating further sequencing of the modules.

In a narrower aspect of the invention, the step of generating a module active time interval comprises the step of generating a time interval having a first portion during which the module generates the identification pulse to the control unit, and a second portion during which the module is enabled to receive a selection pulse from the control unit to select the module for firing.

In a narrower aspect of the invention, the step of generating the identification pulse includes the step of generating a current increase in the firing line power where the amplitude of the firing line current change lies in a predetermined range and where the identification pulse for each module must occur within a predetermined time window from the occurrence of the last identification pulse.

The method further includes the step of connecting the shot in the selected module to the firing line when the module is selected for firing whereby a firing pulse from the firing line can then detonate the selected shot. The method also includes the further step of generating a power reset in each module when each module is first connected to the firing line power thereby initiating the active time interval for that module.

In another aspect of the invention, a single-wire selective perforating system for selectively detonating one at a time a plurality of charges is disclosed. The system includes the control unit operatively connected to the charges by a single firing line which carries both power and control signals between the control unit and the charges. A plurality of selectable firing modules is also included. These modules are vertically connected, one to another, to form an elongated assembly suitable for lowering into a well borehole where the assembly also includes the control unit. Each module contains at least one charge and where each module is automatically connected one at a time to the firing line in a predetermined sequence to receive power therefrom.

In response to receipt of power on the firing line, each module internally generates a module active time interval during which the module and its charge may be selected for firing by the control unit. Each module not selected for firing during its active time interval automatically connects the firing line to the next module in the sequence.

The control means includes a means for detecting the amount of power or current present on the firing line thereby to detect when each module has been connected to the firing line and that the module is drawing the proper amount of current. A means for generating control signals on the firing line is also included in the control means. The control signals generated by the control unit include an arming control signal for selecting and arming a module for firing during the active time interval for the module last connected to the firing line and a firing control signal for detonating the charge in the module selected for firing.

The firing line in each of the firing modules includes both an input and an output portion. Each firing module also comprises an identification pulse generator responsive to the receipt of power on the input portion of the firing line for generating a current increase pulse indicating that the module has been connected to the firing line. Also included is a module active time interval generator responsive to the identification pulse generator for generating the module active time interval during which the module is enabled for selection for firing. A stop pulse detector responds to the arming pulse on the input portion of the firing line and to the time interval generator to terminate the generation of the module active time interval and for connecting the charge in the module to the firing line thereby selecting the module for firing. A pass-through switch is included for connecting in response to the module active time interval generator the input portion of the firing line to the output portion at the end of the module active time interval thereby connecting power to a next firing module in the assembly.

The identification pulse generator comprises a power reset circuit responsive to the receipt of power on the input portion of the firing line for generating a power reset pulse to initiate the active time interval for the module and a load connect means responsive to the power reset pulse for increasing the current on the firing line. The current increase pulse in the firing line current represents the identification pulse of the module.

The firing module active time interval generator comprises a clocking oscillator for generating a digital time base clocking signal to clock a binary counter. The binary counter counts a predetermined number of clock pulses to determine the length of the module active time interval. The counter outputs a first signal when a first portion of the time interval has occurred and outputs a second signal when a second portion of the time interval has occurred.

During the first portion of the time interval, the identification pulse is generated, and during the second portion of the time interval, the module is enabled to receive the arming pulse.

The stop pulse detector comprises a means for detecting an increase in the voltage on the input portion of the firing line where an increase in voltage during the second portion of the active time interval represents the arming pulse. A disabling means is included for disabling the clocking signals to the binary counter and for generating a firing switch signal if an arming pulse is detected by said detecting means during the second portion of the module active time interval. A controllable switch responds to the firing switch signal by connecting the input portion of the firing module to the charge in the firing module thereby arming the module for firing. A zener diode blocking circuit is connected between the firing line and the controllable switch to block voltage pulses of less than a predetermined voltage on the firing line from reaching the selected charge. Only a voltage pulse of sufficient voltage to overcome the zener diode will fire the charge.

BRIEF DESCRIPTION OF THE DRAWINGS

For a fuller understanding of the present invention, reference should be had to the following detailed description taken in connection with the accompanying drawings in which.

Similar reference numerals refer to similar parts throughout the several views of the drawings.

BRIEF DESCRIPTION OF THE PREFERRED EMBODIMENT OF THE INVENTION

Figure 1:
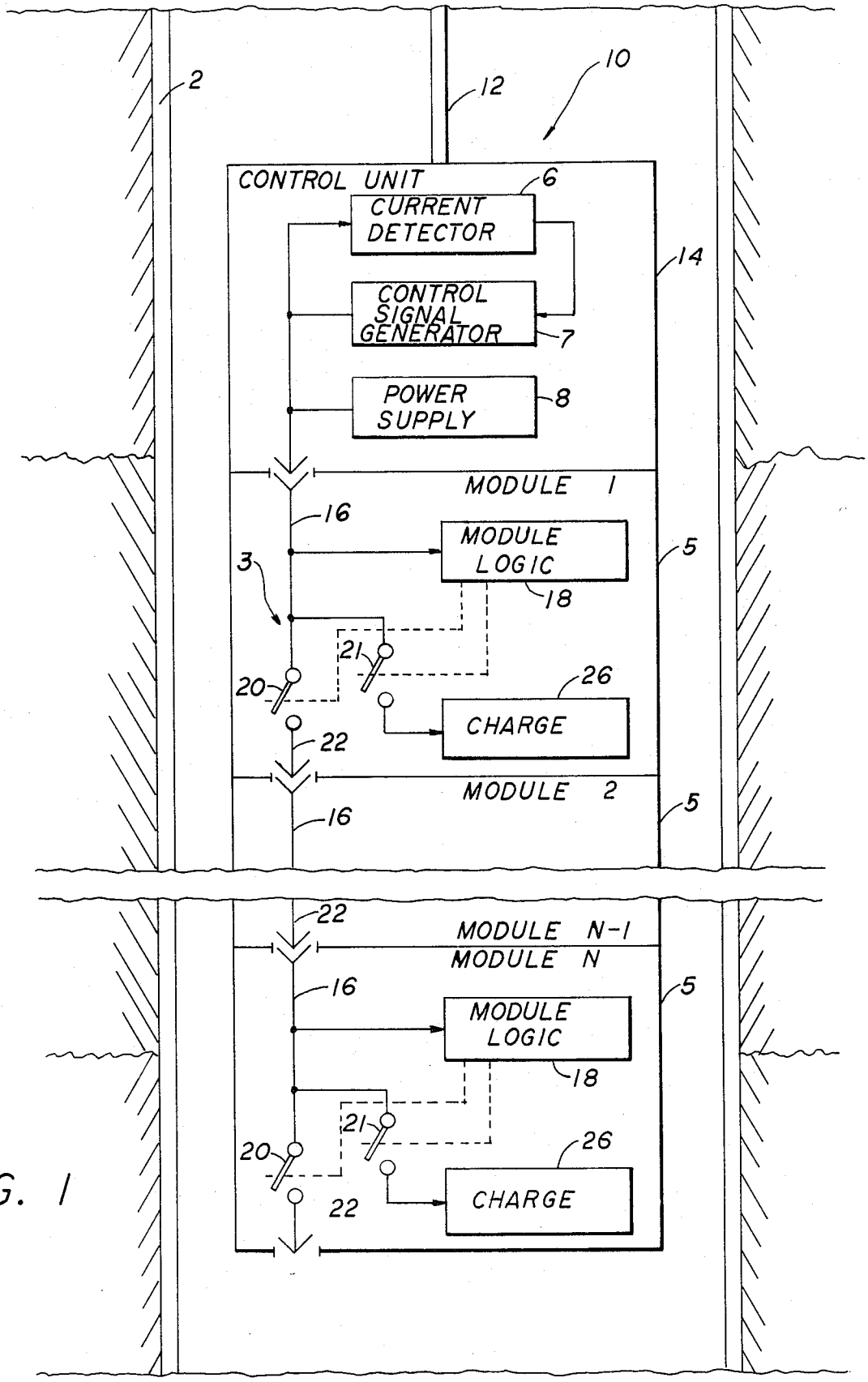
FIG. 1 is an illustration of the firing string for the present invention and is shown suspended in a well borehole.

Referring now to the figures and first to FIG. 1, a firing string 10 according to the present invention is shown suspended by a cable 12 in a well borehole 1 having a well casing 2. The firing string 10 includes a control unit 14 connected to the cable 12 at the uppermost end. Control unit 14 functions to generate the control signals and firing line 3 power needed by the firing modules to select and arm their charges for firing. Connected one to another below the control unit 14 is a plurality of identical firing modules 5 to form an elongated assembly suitable for lowering into the well borehole 1.

Each of the firing modules 5 contains at least one shaped charge 26 with an associated detonator 24 to form a shot or gun for blasting a hole through the well casing 2 into the subsurface formations. Also included in each module is a module logic circuit 18 which functions in cooperation with the control unit 14 and the signals on the firing line 3 generally indicated in FIG. 1 by the segmented signal leads 16, 22 contained in each of the modules 5. As will be discussed below, the firing line from the control unit 14 to the various modules 5 consists of a series of segmented leads which are electrically connected together in sequence to form a single firing line 3 as the various modules are connected one at a time in a prescribed sequence to the control unit 14. Each module 5, when physically connected to another module in the string 10 makes electrical contact with a portion of the firing line of the module to which it is connected. That is, the portion 16 of the firing line of the module just connected makes electrical contact with portion 22 of the next higher module to which it is connected.

Still referring to FIG. 1, each firing module 5 contains a controllable switch means illustrated as switches 20 and 21, which responds to the module logic circuit 18 to either pass the input portion 16 of the firing line 3 coming into the firing module onto the output portion 22 of the firing line 3 which passes the firing line power on down to the next module in the string (switch 20), or connects the input portion 16 of the firing line 3 to the detonator 24 of the shaped charge 26 (switch 21). If switch 21 is closed in a module, that module would be the module selected for firing and the module logic circuit 18 of that selected module would inhibit further sequencing of lower modules in the string 10 by inhibiting switch 20 from being closed to pass the firing line power on through to the next lower module. In those modules sequenced but not selected during their respective active time intervals, the pass-thru switch 20 could also include switching to ground their detonator so that accidental firing cannot occur.

Sequencing of the selectable firing modules begins with the uppermost module connected to the control unit 14. The uppermost module receives power from the control unit 14 when power is first applied to the firing line 3. Thereafter, as each firing module completes its selection process and is not selected for firing, the next lower module in the string is then connected to the firing line. This process continues until the lowermost module has executed its selection sequence.

Figure 2:
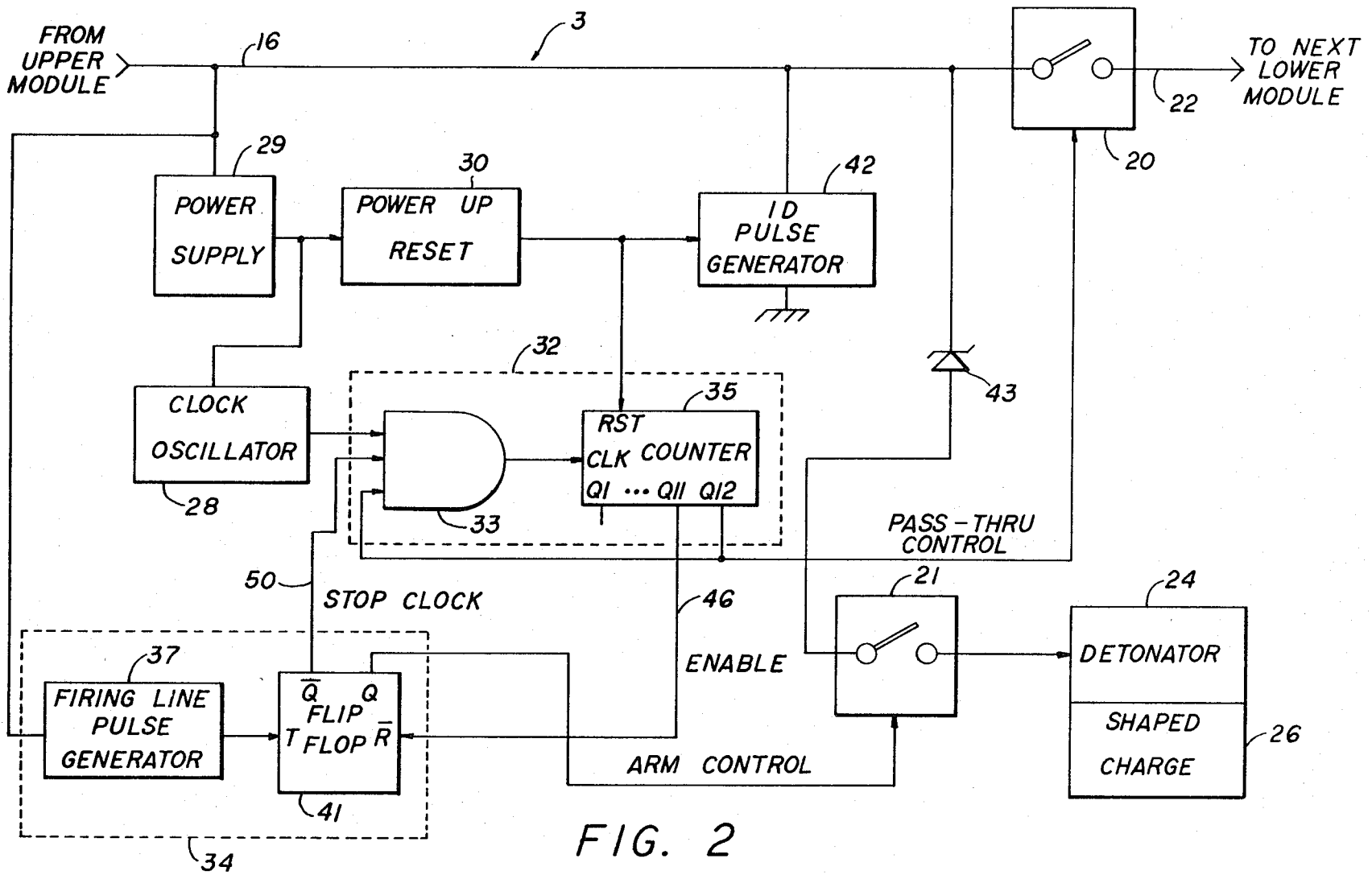
FIG. 2 is a functional block diagram of a typical firing module illustrated in FIG. 1.

The selection sequence for each firing module 5 is best described with reference to FIG. 2 which illustrates the functional block diagram for a typical firing module. Referring now to FIG. 2, the input portion 16 of the firing line 3 is connected to a constant current power supply 29 for regulating the voltage on the firing line 3 to produce the supply voltage for the circuits of the module. The firing line is also connected to a firing line pulse detector 37. The output from firing line pulse detector 37 is connected to a flip-flop 41. Together, pulse detector 37 and flip-flop 41 comprise a stop pulse detector 34 for generating a stop pulse to terminate the module active time interval if the module is to be selected and armed for firing. The firing line pulse detector 37 responds to voltage pulses on the firing line to detect when the control unit 14 has issued selection and arming pulses on the firing line 3.

Also included in each module is a counter circuit means 32 which responds to an internal oscillator clock 28 to produce internally to the module a module active time interval during which the selection of the module for firing is possible. The oscillator clock 28, in conjunction with the number of bits in the binary counter 35 included in the counter means 32, determines the length of the module active time interval. A power reset pulse generator 30 is also included in each module 5 for generating a reset pulse upon the initial receipt of power on the firing line 16. The power reset pulse initiates the start of the active time interval by resetting counter 35.

The power reset pulse has an additional function of generating a current increase pulse on the firing line 3 back to the control unit 14 to indicate that a next module has been connected to the firing line 3. This current pulse is the identification pulse for the module, and must meet certain requirements. First, the magnitude of the increase in the firing line 3 current must be within a predetermined range to indicate that the just connected module is operating in acceptable limits and that only one module is responding to the firing line power. Second, the occurrence of the identification pulse must be within a predetermined window measured from the last identification pulse on the firing line.

An improved single-wire selective perforating system is disclosed in the referenced co-pending application Ser. No. 394,949 filed current herewith, in which the identification pulse generated at the start of the module active time is not a single pulse, but rather, is a plurality of pulses (64 pulses) generated by the internal oscillator 28. From these 64 pulses, a time envelop is developed representing the time it takes the module to generate these 64 pulses. Since each module's oscillator 28 will vary in frequency somewhat module-to-module, the time envelop will represent a signature of the module. By setting each module's time base oscillator 28 to a slightly different value, these time envelops can be made to always be different and unique to the module. Thus, the identification pulse, the envelop, for each module will uniquely identify that module, and counting of the identification pulses for the purpose of locating a specific module is not required. Additionally, noise pulses on the firing line will not be miscounted where 64 pulses are expected in order to represent an identification pulse for a module. A slightly greater or lesser number of pulses may be tolerated and still enable the envelop to uniquely represent the module.

The present invention discloses a system where the selection and arming of a module occurs with receipt of a selection pulse by a module during the second portion of its active time interval. However, it would be obvious to a person of ordinary skill in the art to separate these two functions into two pulses, the first pulse selecting the module and terminating further sequencing, and a second pulse arming the detonator by connecting it to the firing line. However, it is not obvious to employ a sequence of arming pulses where the first pulses generate feedback signals to the control unit as a further check that the module to be armed is responding properly and is the only module so doing.

The control means 14 includes (not shown) a means for detecting the amount of current on the firing line. There are several reasons for monitoring this current. First, by counting the number of identification pulses generated on the firing line, the control means 14 can determine which of the modules has just been connected to the firing line. In this manner, the module to be selected can be detected as the modules automatically sequence through their active times. The control means 14 also includes a means for generating both the selection and arming signals as well as the firing pulse which will detonate the module which has been selected and armed for firing.

Still referring to FIG. 2, the stop pulse detector 34 is shown comprised of a firing line pulse detector 37 which responds to signals on the input portion 16 of the firing line 3, and a flip-flop 41 that, in turn, responds to the output of the firing line pulse detector 37 and the binary counter 35, to generate two control signals. First, a STOP CLOCK signal is outputted by flip-flop 41 on line 50 to one input of an AND gate 33. Also inputted to AND gate 33 is the output from oscillator clock 28. AND gate 33, when enabled, outputs the clocking signal to counter 35. The signal STOP CLOCK functions as a disable signal to inhibit further clocking of the counter 35 when the selection pulse is received on the firing line 3.

When the signal STOP CLOCK goes to a logic zero, AND gate 33 will be inhibited from supplying any further clock signals to the counter 35. At the same time that STOP CLOCK goes to a logic zero, the signal ARM CONTROL, also outputted by flip-flop 41, goes to a logic one. ARM CONTROL appears on signal lead 39 to the firing switch 21. The signal ARM CONTROL closes the firing switch 21 to connect the cathode of zener diode 43 to the detonator 24 associated with the shaped charge 26 of the module. The anode portion of the zener diode 43 is connected to the input portion 16 of the firing line 3. For this preferred embodiment of the invention, the selection pulse on firing line 3 also acts to arm the module for firing.

The improved single-wire selective perforating system referred to above, has separated the selection and arming functions to improve the feedback safeguards to avoid failures during firing that result in faulty operations. Specifically, a single pulse is used to select a module and a sequence of three arming pulses is used to arm the module in a predetermined sequence. The first arming pulse causes the module to be armed to produce a current increase in the firing line 3 current. This current increase must be within a predetermined range. A second arming pulse will remove this current increase. If the value of the current increase is acceptable and the increase was cleared by the second arming pulse, then a third pulse is issued to arm the module for firing. The firing pulse to detonate the charge can then be issued with the assurance that one and only one module will be fired.

Still referring to FIG. 2, the flip-flop 41 of the stop pulse detector 34 functions as a set-reset type flip-flop where the set signal comes from the firing line pulse detector 37 and the reset signal comes from the counter 35. The reset signal to flip-flop 41 is labeled ENABLE and is at a logic one state when the Q11 output from the 12-bit binary counter 35 is true. When the reset input to flip-flop 41 is at a logic one, the flip-flop can be "set" to a logic one by a pulse on the set input. Thus, a pulse detected by the firing line pulse detector 37 will cause flip-flop 41 to change states (logic zero to logic one) only if the signal ENABLE on signal lead 46 from counter 35 is true. During the first portion of the active time interval for the module, the signal ENABLE will not be at a logic one. After a certain number of clock pulses have been counted, ENABLE goes true making the start of the second portion of the module active time interval. It is during this second portion that the module may be selected and armed.

Also inputted to the AND gate 33 is another output from the binary counter 35 (Q12) which represents the most significant bit from the 12-bit counter. The signal on the Q12 output, PASS-THROUGH, also controls the pass-through switch 20 which functions to connect the input portion 16 of the firing line 3 to the output portion 22. Additionally, the signal PASS-THROUGH disables clock signals from the oscillator clock 28 from reaching the counter 35. As previously discussed, the flip-flop 41 enables the AND gate 33 to pass clock pulses from oscillator 28 to the counter 35 irrespective of whether any pulses are detected by the firing line pulse detector 37 during the first portion of the active interval.

The lapsing of the first portion of the time interval is indicated when the signal ENABLE on signal lead 46 goes to a logic one thereby permitting any subsequent pulses detected by the firing line pulse detector 37 to set the flip-flop 41 and disable AND gate 33. In the event that no firing line pulses are detected by detector 37 during the second portion of the active time interval, then the Q12 output of counter 35 will eventually go true and produce the signal PASS-THROUGH to inhibit further clocking of the counter 35. Simultaneously, the pass-through switch 20 is closed to pass the firing line power on to the next module down the sequence. Closure of the pass-through switch 20 represents the end of the selection process for the module with the module thereafter connected to the firing line power. Further clocking of the counter 25 is inhibited until the module is reset by removal of power on the firing line 3.

Figure 3:
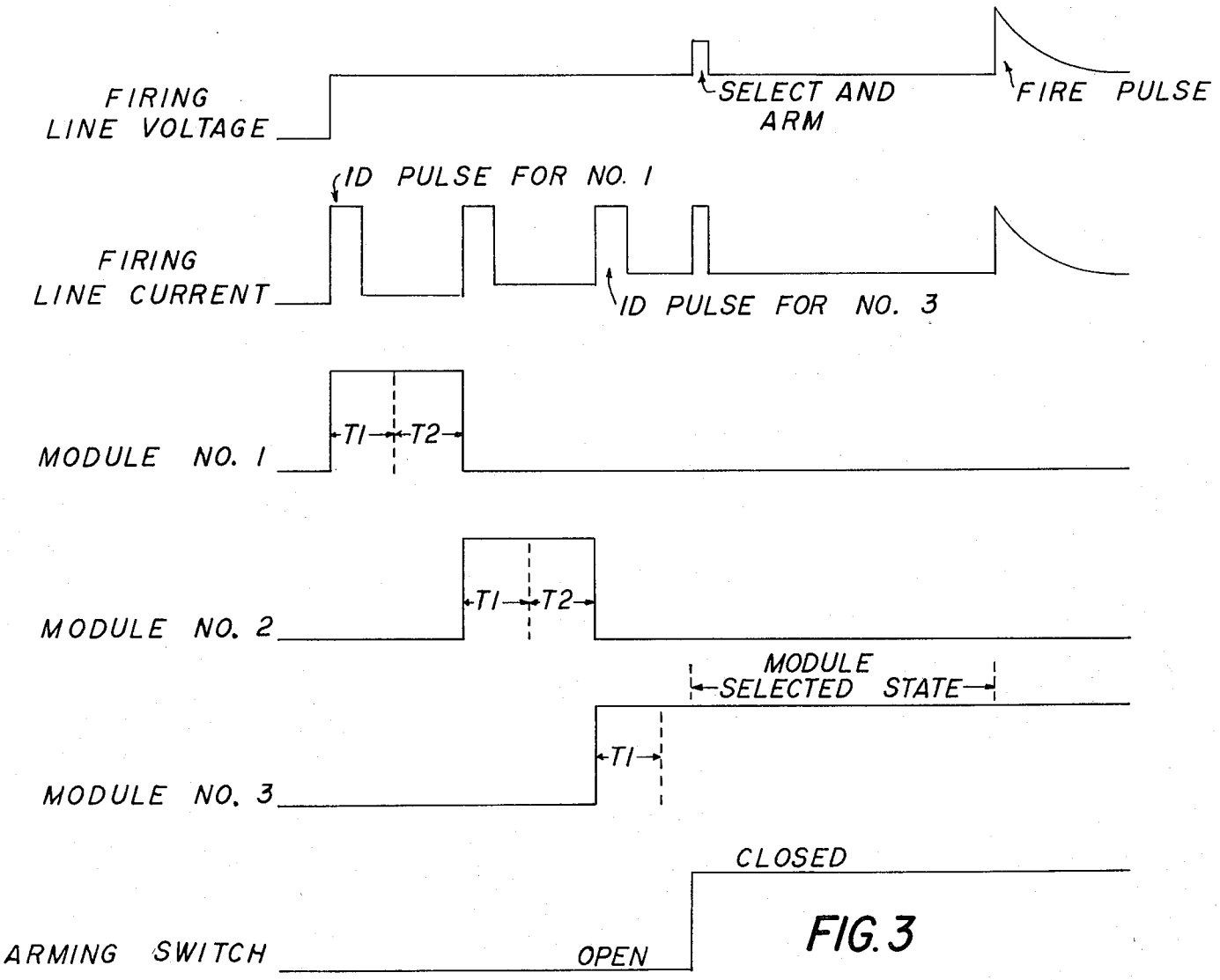
FIG. 3 is a timing diagram illustrating operations of the present invention for selecting, arming and firing a selected module in the firing string.

The timing relationships between the signals of the control unit 14 and the plurality of firing modules during the sequencing of the modules is illustrated in FIG. 3. Referring now to FIG. 3, the voltage and current on the firing line are illustrated for a typical selection sequence involving three firing modules with the third module representing the module to be selected. With application of power in the form of voltage and current on the firing line, module No. 1 will begin to internally generate its module active time interval. The active time interval for each module is illustrated in FIG. 3 as composed of two portions, a first and second portions T1 and T2, respectively. The first portion T1 represents the time interval from the initial receipt of power in the module to the time when Q11 of binary counter 35 goes true. The second portion of the time interval T2 represents the remaining portion of the active time interval and represents the time that Q11 from counter 35 is true. In other words, the end of the second portion T2 of each module time interval in indicated when the Q12 output of the binary counter 35 goes true and Q11 goes false (a true state is represented by a logic one and a false state represented by a logic zero).

Upon receipt of power by the module No. 1, an identification pulse is generated on the firing line 3. The pulse is shown as a current increase in the firing line current. The increase indicates to the control unit 14 that a module has been connected to the firing line. If the amplitude of the current increase on the firing line for the identification pulse does not fall within a predetermined range, the control unit 14 will cease sequencing of the modules because a faulty operation, such as more than one module 5 responding to the application of power on the firing line 3 or that the module just connected is not operating within predetermined limit, is indicated. As the signal for the firing line current shown in FIG. 3 indicates, there is an increase in the firing line current each time that another module is connected to the firing line apart from the superimposed current increase pulse for the identification pulse. These increases in firing line current result because each module remains connected to the firing line current at the end of its module active time interval and continues to draw current until reset by removal of the firing line power.

For the example illustrated in FIG. 3, at the end of the module active time interval for module 1, its pass-thru switch 20 is closed to connect module 2 to the firing line power. As shown in FIG. 3, module 2 and module 1 are now connected to the firing line resulting in a net increase in the amount of current on the firing line. This is generally illustrated as a step function increase. Superimposed on this step increase is the identification pulse for module No. 2.

In addition to the identification pulse amplitude falling within a predetermined range, the control unit 14 monitors the time interval as measured from the receipt of the last identification pulse to receipt of the next identification pulse. Unless each identification pulse falls within a predetermined time window measured from the last pulse on the firing line 3, the control unit 14 will terminate further sequencing of the firing modules because a faulty situation is indicated.

An additional function of the identification pulses to the control unit 14 is to function as a clocking pulse to enable the control unit 14 to count which of the modules has just been connected to the firing line 3 power. Thus, when the identification pulse for module 3 is received and the identification pulse conditions are met, control unit 14 will know that the module to be selected, module 3, has just been connected to the firing line 3.

As previously discussed, any pulses occurring on the firing line during the first portion of the time interval will have no effect on the selection and arming of a module. Only during the second portion of the active time interval $T_2$ will the flip-flop 41 be enabled to receive setting pulses detected by the firing line pulse detector 37 to select and arm the module. In the example illustrated in FIG. 3, since module No. 3 is the module to be selected, the control unit 14 will generate a selection and arming pulse on the firing line indicated as a voltage pulse on the firing line voltage during T2 for module No. 3. When the firing line pulse detector 37 detects the voltage pulse on the firing line voltage during the second portion of the module active time interval, flip-flop 41 will be triggered to terminate further counting of the counter 35 and to generate ARM CONTROL to the firing switch 21. With ARM CONTROL true, firing switch 21 will be closed connecting the detonator 24 in module No. 3 to the firing line through its zener diode 43.

Since further clocking of counter 35 has been terminated by receipt of the selection pulse and the setting of flip-flop 41, the module will no longer be in an active time interval generation operation, but will have to be in a selected state. Further selection of lower modules is terminated and detonation of module No. 3 can occur at any time control unit 14 wishes to apply a firing pulse on the firing line. Should detonation of the selected and armed module not be desired, the selection sequencing process can be repeated by resetting all of the modules back to the initial state by removing the firing line voltage and current momentarily. When the power is removed, all the pass-through switches 20 and the firing switch 21 in module 3 will be switched to their open position so that only the first module connected to the control unit 14 will receive power on the firing line 3 once power is again returned.

Summarizing the present invention, a single-wire selective perforating gun system is disclosed in which a plurality of identical firing modules are connected, one to another, to form an elongated assembly suitable for lowering into a well borehole. Included in the assembly is a control unit for generating power and firing line signals to each of the firing modules as each module is connected one at a time in a sequence to the control unit.

Each of the firing modules generates internally an active time interval during which the module can be selected and armed for firing by the control unit. The active time interval begins when power is applied to the module by connection of the module to the firing line. Each firing interval has a first and a second portion. During the first portion, the firing module generates an identification pulse to the control unit to indicate that a next module has been connected to the firing line. In this way, the control unit counts the modules as they are connected to the firing line to determine when the module to be selected is generating an active time interval. During the second portion of the module active time interval, the control unit may select a module for firing by issuing a selection control pulse onto the firing line. Pulses on the firing line during the first portion of the active time interval are disregarded by the module since a module may only be selected and armed during the second portion of the time interval.

As a safeguard against attempting to fire a module when conditions of the modules do not permit, each module generates an identification pulse on the firing line which the control unit monitors to determine if the module is operating within acceptable power limits and that the sequencing through the modules has occurred within prescribed time limits. Only when conditions are proper will the control unit select and arm for firing the module to be selected.

In describing the invention, reference has been made to its preferred embodiment. However, those skilled in the art and familiar with the disclosure of the invention may recognize additions, deletions, substitutions or other modifications which would fall within the purview of the invention as defined in the appended claims. For example, the invention has been described with reference to a single firing line 3 which carries both power and control signals between the control unit 14 and the plurality of firing modules 5. It will be obvious that the advantages of the present invention may be obtained by using more than one signal line to carry power and control signals to the modules. A signal line to carry the control signals for selection and arming separate and apart from the firing line power and feedback signals could be employed where the signal lines are segmented in the same way as disclosed herein.

What is claimed is:

1. In a single-line selective perforating system having a single firing line for electrically connecting a firing control unit to each of a plurality of shot modules, one at a time in a predetermined sequence, where each module is adapted for connecting the connected control unit to a next module, a method of selecting a module for firing comprising the step of connecting each module one at a time in the predetermined sequence to the firing line under control of module active time intervals internally generated in the modules, where each module generates its active time interval in response to being connected to the firing line with the next module in the sequence automatically connected to the firing line at the end of the active time for the last connected module if that module was not selected for firing during its active time interval.

2. The method of claim 1 wherein the step of connecting each module to the firing line comprises the steps of:

(a) applying power to the firing line in the form of voltage and current for powering the modules connected to the firing line;

(b) generating a module active time interval in the module last connected to the firing line power;

(c) generating from the module just connected to the firing line power an identification pulse to indicate to said control unit that a next module has been connected to the firing line power;

(d) controlling at the end of each module active time interval a pass-thru switch to pass the firing line power to the next module in the sequence if the module was not selected; and (e) repeating steps (b)–(d) until the module to be selected is generating an active time interval wherein said control unit may generate a selection pulse to select the module for firing thereby terminating further sequencing of the modules.

3. The method of claim 2 wherein the step of generating a module active time interval comprises the step of generating a time interval having, (a) a first portion during which the module generates the identification pulse, and (b) a second portion during which the module is enabled to receive a selection pulse from said control unit to select the module for firing.

4. The method of claim 2 wherein the step of generating the identification pulse includes the step of generating a current increase in the firing line power where the amplitude of the firing line current change lies in a predetermined range.

5. The method of claim 4 wherein the identification pulse for each module must occur within a predetermined time window from the occurrence of the last identification pulse.

6. The method of claims 1, 3 or 5 further including the step of grounding the shot in each module that was connected to but not selected by said control unit.

7. The method of claim 6 further including the step of connecting the shot in the selected module to the firing line when the module is selected for firing whereby a firing pulse on the firing line can detonate the selected shot.

8. The method of claim 7 further including the step of generating a power reset in each module when each module is connected to the firing line power thereby initiating the active time interval for that module.

9. The method of claim 3 wherein the first and second portions of each active time interval are equal in length.

10. In a single-line selective perforating system having a firing control means, a plurality of modules connected in a string adapted for insertion into a well borehole where each module is connected one to the other from a lowermost to an uppermost module with each module containing at least one shaped charge or shot for perforating a well casing into the subsurface formations, and a controllable pass-through switch means for passing a single firing line to the next lower module in the string, a method of selecting a module to be fired comprising the steps of:

(a) applying to the firing line electrical power having voltage and current of sufficient magnitude to power the modules but without sufficient power to fire a shot;

(b) generating internal to the module last connected to the firing line power a module active time interval during which the module may be selected for firing by a selection signal, the modules automatically sequencing to another module at the end of each time interval;

(c) generating during each module active time interval an identifying pulse to identify to the firing control means that a next module has been connected to the firing line; and (d) generating during a module active time interval a selection pulse if the active module is to be selected whereby the module is selected for firing by a firing pulse of sufficient power on the firing line to detonate a shot.

11. The method of claim 10 further including the step of controlling said pass-through switch means in the last connected module at the end of its module active time interval to connect the next lower module in the string to the firing line if that module was not selected thereby powering up the next lower module.

12. The method of claim 10 wherein said step of generating a module active time interval includes the steps of:

(a) generating a first portion of the active time interval during which the identification pulse of the module is generated to said control means; and (b) generating a second portion of the active time during which the module is enabled to receive the selection signal to select the module.

13. The method of claim 10 or 12 wherein said identification pulse is a current pulse on the firing line whose incremental change in the current level must fall within a predetermined level for the control means to select and fire the module.

14. The method of claim 13 wherein the identification pulse for the next module connected to the firing line must occur within a predetermined time window of the previous identification pulse on the firing line.

15. The method of claim 14 further including the step of firing a shot by applying a power pulse on the firing line of sufficient energy to detonate the shot in the module which has been selected for firing.

16. The method of claim 12 wherein the step of generating a module active time for each module includes the step of generating a power reset pulse in the module when a module is first connected to the firing line power.

17. The method of claim 16 wherein each module connected to the firing line but not selected remains connected to the firing line in an inactive state, and where the modules in an inactive state may be reset to once again be sequenced by momentarily removing the power from the firing line.

18. In a single-firing line selective perforating system for detonating a plurality of charges in a shot string comprised of a plurality of series connected firing modules, each firing module containing a charge to be detonated by application of a firing pulse on the firing line, and each module electrically powered by power signals from the firing line, a method of selecting and firing the modules comprising the steps of:

(a) generating internal to each module as each module is connected, one at a time in a sequence to the firing line power signals, a module active time interval having a first and a second portion;

(b) generating in each module during the first portion an identifying pulse of predetermined amplitude to identify that the module has been connected to the firing line;

(c) connecting the next module in the string to receive power to the firing line at the end of the second portion of the module active time interval for the module last connected to the firing line; and (d) generating during the second portion of the active time for the module to be selected a pulse to select and arm the module, the module so selected remaining selected until fired or reset.

19. The method of claim 18 further including the step of connecting to the firing line the detonation portion of the charge in the module selected to be fired in response to the selection and arming pulse whereby the firing pulse on the firing line can detonate the selected charge.

20. The method of claims 18 or 19 wherein the identification pulse for each module must (a) have an amplitude which lies in a predetermined range, and (b) occur within a predetermined time window measured from the occurrence of the last identification pulse on the firing line.

21. In a single-line selective perforating system having a single firing line for connecting a control unit to a plurality of shot modules, each adapted to be electrically connected in a predetermined sequence to the firing line where each connected module receives both power and firing control signals from the control unit over the firing line, a method of selecting a module for firing from among the plurality of modules comprising the steps of:

(a) generating internal to each module in response to receipt of the power signals on the firing line (i) a module active time interval during which the module may be selected for firing by a selection control signal from the control unit, and (ii) an identification pulse for transmission over the firing line to the control unit to indicate that a next module has been connected to the firing line; and (b) automatically connecting the firing line to the next module in the sequence at the end of the module active time for the last connected module if that module was not selected for firing during its active time.

22. The method of claim 21 wherein each module active time interval includes (a) a first portion during which the module generates and applies the identification pulse onto the firing line, and (b) a second portion during which the module is enabled to receive a selection pulse on the firing line from the control unit to select the module for firing.

23. The method of claim 21 wherein the step of generating the identification pulse includes the step of generating a current increase in the firing line power where the amplitude of the firing line current change lies in a predetermined range.

24. The method of claim 23 wherein the identification pulse for each module must occur within a predetermined time window measured from the occurrence of the last identification pulse.

25. The method of claims 21, 22 or 24 further including the step of grounding the shot in each module that was connected to but not selected by the control unit.

26. The method of claim 25 further including the steps of (a) generating an arming pulse to the active module when that module is to be armed for firing; and (b) connecting the detonation portion of the shot in the selected module to the firing line when the module is armed for firing by the arming pulse whereby a firing pulse on the firing line can detonate the selected shot.

27. The method of claim 26 further including the step of generating a power reset in each module when each module is connected to the firing line thereby initiating each active time interval.

28. The method of claim 22 wherein the first and second portions of each active time interval are equal in length.

29. A single-wire selective perforating system for selectively detonating the charges in a plurality of firing modules, one at a time, comprising:

(a) a control unit operatively connected to the modules by a single firing line which carries both power and control signals between said control unit and the modules; and (b) a plurality of selectable firing modules vertically connected one to another to form an elongated assembly suitable for lowering into a well borehole, the assembly including said control unit, each module, (i) containing at least one charge and where each module is automatically connected one at a time to the firing line in a predetermined sequence to receive power therefrom, and (ii) in response to receipt of power on the firing line, internally generates a module active time interval during which the module and its charge may be selected for firing by said control unit, each module not selected for firing during its active time interval automatically connecting the firing line to the next module in the sequence.

30. The system of claim 29 wherein said control unit includes:

(a) a means for detecting the amount of power current present on the firing line, thereby to detect when each module has been connected to the firing line; and (b) a means for generating control signals on the firing line including (i) a selection control signal for selecting a module for firing during the active time interval for the module last connected to the firing line, and (ii) a firing control signal for detonating the charge in the module selected for firing.

31. The system of claims 29 or 30 wherein the firing line in each of said firing modules includes an input and an output portion, each said firing module comprising:

(a) an identification pulse generator responsive to the receipt of power on the input portion of the firing line for generating a pulse indicating that the module has been con nected to the firing line;

(b) a module active time interval generator responsive to said identification pulse generator for generating the module active time interval during which the module may be selected for firing;

(c) a stop pulse detector responsive to a selection pulse on the input portion of the firing line and to said time interval generator for terminating the generation of the module active time interval, and for connecting the charge in the module to the firing line thereby selecting the module for firing; and (d) a pass-through switch responsive to said module active time interval generator for connecting at the end of the module active time interval the input portion of the firing line to the output portion thereby connecting power to a next firing module in the assembly.

32. The system of claim 31 wherein said identification pulse generator comprises:

(a) a power reset circuit responsive to the receipt of power on the input portion of the firing line for generating a power reset pulse to initiate the active time interval for the module; and (b) a load connect means responsive to the power reset pulse for increasing the current on the firing line, the current pulse increase in firing line current representing the identification pulse of the module.

33. The system of claim 31 wherein said firing module active time interval generator comprises:

(a) a clocking oscillator for generating a digital time base clocking signal; and (b) a binary counter responsive to said stop pulse detector and the clocking signal for counting a predetermined number of clock pulses to determine the length of the module active time interval, said counter (i) outputting a first signal when a first portion of the time interval has occurred, and (ii) outputting a second signal when a second portion of the time interval has occurred.

34. The system of claim 33 wherein (a) the identification pulse is generated during the first portion of the time interval, and (b) the module is enabled to receive a selection pulse during the second portion of the time interval.

35. The system of claim 33 wherein said stop pulse detector comprises:

(a) a means for detecting an increase in voltage on the input portion of the firing line, an increase in voltage during the second portion of the active time interval representing the selection pulse;

(b) a disabling means responsive to the detecting means and to said module time interval generator for disabling the clocking signals to said binary counter and for generating a firing switch signal if a selection pulse is detected by said detecting means during the second portion of the module active time interval; and (c) a controllable switch responsive to the firing switch signal for connecting the input portion of the firing line to the charge in said firing module.

36. The module of claim 35 wherein said stop pulse detection means further includes a zener diode connected between the firing line and said controllable switch for blocking any voltage pulses of less than a predetermined voltage from reaching the charge when the module has been selected for firing, the firing pulse having a voltage amplitude greater than the predetermined voltage.

37. A firing module for use in a single-wire selective perforating system, the system having a plurality of said firing modules vertically connected to form an elongated assembly suitable for lowering into a well borehole, and includes a control means for generating power and control signals on a single firing line connectable to each of said modules, each firing module comprising:

(a) at least one shot, each shot including a detonator responsive to a firing pulse from said control means for detonating its associated shot;

(b) an identification pulse generator responsive to the receipt of power on the firing line for generating a current pulse on the firing line indicating that the module has been connected to the firing line;

(c) a module active time interval generator responsive to said identification pulse generator for generating a module active time interval during which the module may be selected for firing by said control means;

(d) a stop pulse detector responsive to a selection pulse on the firing line and to said time interval generator for terminating the generation of the module active time interval, and for connecting said detonator to the firing line thereby selecting the module for firing; and (e) a pass-through switch responsive to said module active time interval generator for passing the power on the firing line through the module at the end of the module active time interval thereby providing power to another module in the assembly.

38. The module of claim 37 wherein said identification pulse generator comprises:

(a) a power reset circuit responsive to the receipt of power on the firing line for generating a power reset pulse to initiate the start of the module active time interval; and (b) a load connect means for connecting a load to the firing line thereby increasing the current on the firing line, the pulse increase in firing line current representing the identification pulse of the module.

39. The module of claim 37 wherein said module active time interval generator comprises:

(a) a clocking oscillator for generating a digital time base clocking signal; and (b) a binary counter responsive to said stop pulse detector and the clocking signal for counting a predetermined number of clock pulses to determine the length of the module active time interval, said counter (i) outputting a first signal when a first portion of the time interval has occurred, and (ii) outputting a second signal when a second portion of the active time interval has occurred.

40. The module of claim 39 wherein (a) the identification pulse is generated during the first portion of the time interval, and (b) the module is enabled to receive the selection pulse during the second portion.

41. The module of claims 39 or 40 wherein said stop pulse detector comprises:

(a) a means for detecting an increase in voltage on the firing line, an increased voltage during the second portion of the active time interval representing the arming pulse;

(b) a disabling means responsive to the detecting means and to said module time interval generator for disabling the clocking signals to said binary counter and for generating a firing switch signal if a selection pulse is detected by said detecting means during the second portion of the module active time interval; and (c) a controllable switch responsive to the firing switch signal for connecting the firing line to said detonators in the module.

42. The module of claim 41 wherein said stop pulse detection means further includes a zener diode connected between the firing line and said controllable switch for blocking any voltage pulses of less than a predetermined voltage from reaching said detonators after the module has been selected for firing, the firing pulse from said control unit having a voltage greater than the predetermined voltage.

43. In a selective perforating system having a plurality of signal lines including a firing line for electrically connecting a firing control unit to each of a plurality of shot modules one at a time in a predetermined sequence where each module is adapted for connecting the connected control unit to a next module, a method of selecting a module for firing comprising the step of connecting each module one at a time in the predetermined sequence to the firing line under control of module active time intervals internally generated in the modules, where each module generates an active time interval in response to being connected to the firing line with the next module in the sequence automatically connected to the firing line at the end of the active time for the last connected module if that module was not selected for firing by the control unit during its active time interval.

44. The method of claim 43 wherein the step of connecting each module to the firing line comprises the steps of:

(a) applying power to the firing line in the form of voltage and current for powering the modules connected to the firing line;

(b) generating a module active time interval in the module last connected to the firing line power;

(c) generating from the module just connected to the firing line power an identification pulse to indicate to said control unit that a next module has been connected to the firing line power;

(d) controlling at the end of each module active time interval a pass-thru switch to pass the firing line power to the next module in the sequence if the module was not selected; and (e) repeating steps (b)–(d) until the module to be selected is generating an active time interval wherein said control unit may generate a selection pulse to select the module for firing thereby terminating further sequencing of the modules.

45. The method of claim 44 wherein the step of generating a module active time interval comprises the step of generating a time interval having, (a) a first portion during which the module generates the identification pulse, and (b) a second portion during which the module is enabled to receive a selection pulse from said control unit to select the module for firing.

46. In a selective perforating system having a firing control means, a plurality of modules connected in a string adapted for insertion into a well borehole where each module is connected one to the other from a lowermost to an uppermost module with each module containing at least one shaped charge or shot for perforating a well casing into the subsurface formations, and a controllable pass-through switch means for passing a single firing line to the next lower module in the string, a method of selecting a module to be fired comprising the steps of:

(a) supplying to the modules one at a time electrical power having voltage and current of sufficient magnitude to power the modules but without sufficient power to fire a shot;

(b) generating internal to the module last connected to the power a module active time interval during which the module may be selected for firing by a selection signal, the modules automatically sequencing power to another module at the end of each time interval;

(c) generating during each module active time interval an identifying pulse to identify to the firing control means that a next module has been connected to the power and is generating an active time interval; and (d) generating during a module active time interval a selection pulse if the active module is to be selected whereby the module is selected for firing by a firing pulse of sufficient power on the firing line to detonate a shot.

47. The method of claim 46 further including the step of controlling said pass-through switch means in the last connected module at the end of its module active time interval in order to connect the next lower module in the string to the power if that module was not selected, thereby powering up the next lower module.

48. The method of claim 46 wherein said step of generating a module active time interval includes the steps of:

(a) generating a first portion of the active time interval during which the identification pulse of the module is generated to said control means; and (b) generating a second portion of the active time during which the module is enabled to receive the selection signal to select the module.

49. The method of claim 48 wherein each module connected to the firing line but not selected remains connected to the firing line in an inactive state, and where the modules in an inactive state may be reset to once again be sequenced by momentarily removing the power to the modules.

50. In a selective perforating system for detonating a plurality of charges in a shot string comprised of a plurality of series connected firing modules, each firing module containing a charge to be detonated by application of a firing pulse on a firing line, and each module electrically powered by power signals from the firing line, a method of selecting and firing the modules comprising the steps of:

(a) generating internal to each module as each module is connected, one at a time in a sequence to the firing line power signals, a module active time interval having a first and a second portion;

(b) generating in each module during the first portion an identifying pulse of predetermined amplitude to identify that the module has been connected to the firing line;

(c) connecting the next module in the string to receive power to the firing line at the end of the second portion of the module active time interval for the module last connected to the firing line; and (d) generating during the second portion of the active time for the module to be selected a pulse to select and arm the module, the module so selected remaining selected until fired or reset.

51. In a selective perforating system having a plurality of signal lines including a firing line for connecting a control unit to a plurality of shot modules, each adapted to be electrically connected in a predetermined sequence to the firing line where each connected module receives both power and a firing signal from the control unit over the firing line, a method of selecting a module for firing from among the plurality of modules comprising the steps (a) generating internal to each module in response to receipt of the power signals on the firing line (i) a module active time interval during which the module may be selected for firing by a selection control signal from the control unit, and (ii) an identification pulse for transmission to the control unit to indicate that a next module has been connected to the firing line; and (b) automatically connecting the firing line to the next module in the sequence at the end of the module active time for the last connected module if that module was not selected for firing during its active time.

52. The method of claim 51 wherein each module active time interval includes (a) a first portion during which the module generates the identification pulse, and (b) a second portion during which the module is enabled to receive a selection pulse from the control unit to select the module for firing.

53. The method of claim 52 further including the steps of:

(a) generating a selection pulse to the active module when that module is to be selected for firing;

(b) generating an arming pulse to the active module when that module is to be armed for firing; and (c) connecting the detonation portion of the shot in the selected module to the firing line when the module is armed for firing by the arming pulse whereby a firing pulse on the firing line can detonate the selected shot.

54. A selective perforating system for selectively detonating the charges in a plurality of firing modules, one at a time, comprising:

(a) a control unit operatively connected to the modules by a plurality of signal lines including a firing line, the signal line supplying both power and control signals between said control unit and the modules; and (b) a plurality of selectable firing modules vertically connected one to another to form an elongated assembly suitable for lowering into a well borehole, the assembly including said control unit, each module, (i) containing at least one charge and where each module is automatically connected one at a time to said control unit in a predetermined sequence to receive power therefrom, and (ii) in response to receipt of power, internally generates a module active time interval during which the module and its charge may be selected for firing by said control unit, each module not selected for firing during its active time interval automatic ally connecting power and the firing line to the next module in the sequence.

55. The system of claim 54 wherein said control unit includes:

(a) a means for detecting the amount of power current delivered to said connected modules, thereby to detect when each module has been connected to the firing line; and (b) a means for generating control signals to said connected modules including (i) a selection control signal for selecting a module for firing during the active time interval for the module last connected to the firing line, and (ii) a firing control signal for detonating the charge in the module selected for firing.

56. A firing module for use in a selective perforating system, the system having a plurality of said firing modules vertically connected to form an elongated assembly suitable for lowering into a well borehole, and includes a control means for generating power and control signals on a plurality of signal lines including a firing line connectable to each of said modules, each firing module com- prising:

(a) at least one shot, each shot including a detonator responsive to a firing pulse from said control means for detonating its associated shot;

(b) an identification pulse generator responsive to the receipt of power for generating a current pulse to said control means indicating that the module has been connected to the firing line;

(c) a module active time interval generator responsive to said identification pulse generator for generating a module active time interval during which the module may be selected for firing by said control means;

(d) a stop pulse detector responsive to a selection pulse from said control means and to said time interval generator for terminating the generation of the module active time interval, and for connecting said detonator to the firing line thereby selecting and arming the module for firing; and (e) a pass-through switch responsive to said module active time interval generator for passing the power through the module at the end of the module active time interval thereby providing power to another module in the assembly.

57. The module of claim 56 wherein said identification pulse generator comprises:

(a) a power reset circuit responsive to the receipt of power for generating a power reset pulse to initiate the start of the module active time interval; and (b) a load connect means for connecting a load to the module power thereby increasing the power current, the pulse increase in power current representing the identification pulse of the module.

58. The module of claim 56 wherein said module active time interval generator comprises:

(a) a clocking oscillator for generating a digital time base clocking signal; and (b) a binary counter responsive to said stop pulse detector and the clocking signal for counting a predetermined number of clock pulses to determine the length of the module active time interval, said counter (i) outputting a first signal when a first portion of the time interval has occurred, and (ii) outputting a second signal when a second portion of the active time interval has occurred.

59. The module of claim 58 wherein (a) the identification pulse is generated during the first portion of the time interval, and (b) the module is enabled to receive the selection pulse during the second portion.

* * * * *